US006648682B1

(12) United States Patent
Wu

(10) Patent No.: US 6,648,682 B1
(45) Date of Patent: Nov. 18, 2003

(54) ELECTRICAL CONNECTOR HAVING BOARD LOCKS

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/202,931

(22) Filed: Jul. 24, 2002

(51) Int. Cl.[7] ..... H01R 13/73
(52) U.S. Cl. ..... 439/567; 439/374
(58) Field of Search ..... 439/567, 569, 439/570, 571, 374, 378, 680, 79, 377

(56) References Cited

U.S. PATENT DOCUMENTS 5,171,165 A * 12/1992 Hwang ..... 439/567
5,422,789 A * 6/1995 Fisher et al. ..... 361/719
5,468,154 A * 11/1995 Yip et al. ..... 439/79
5,468,160 A * 11/1995 Broschard, III ..... 439/567
5,921,811 A * 7/1999 Hsu ..... 439/567
6,083,044 A * 7/2000 Wang et al. ..... 439/567
6,331,122 B1 12/2001 Wu
6,435,905 B1 * 8/2002 Yu et al. ..... 439/567

* cited by examiner

*Primary Examiner*—Hien Vu
(74) *Attorney, Agent, or Firm*—Wei Te Chung

(57) ABSTRACT

An electrical connector (10) for mating with a mating connector includes an insulative housing (12) having a base portion (13), a pair of guiding portions (26) extending upwardly from opposite ends of the base portion, a pair of mounting sections (17) under the grounding portions, a plurality of contacts (14) received in the housing, and a pair of board locks (16) mounted to the mounting sections of the housing. Each board lock comprises a main base (162) abutting against a bottom face (22) of the mounting section, a first beam (163) extending upwardly from the main base and securely retained to the mounting section, a pair of second beams (164) extending upwardly from opposite sides of the main base and securely retained into the mounting section, the second beams being opposite to each other and perpendicular to the first beam.

6 Claims, 12 Drawing Sheets

ELECTRICAL CONNECTOR HAVING BOARD LOCKS

FIELD OF THE INVENTION

The present invention relates to an electrical connector, and particularly to an electrical connector having a pair of board locks which can prevent the electrical connector rotation when the electrical connector is soldered onto the printed circuit board (PCB).

DESCRIPTION OF THE RELATED ART

Computers are widely used in the fields of E-commerce, E-business, Home network, internet workstation and so on. Each computer has a data storage center, e.g. hard disk, where computer software and business data information are saved. When the computer runs, the computer Central Processing Unit (CPU) continuously accesses the hard disk and takes data from the hard disk or saves data to the hard disk. The CPU is commonly connected to the hard disk via flat flexible cables (FFCS) and FFC connectors assembled to opposite ends of the FPCS. For compatibility, the hard disk driver interfaces are standardized. There are many hard disk driver interface standards and the SCSI families and ATA families are the most famous in the last decade. The electrical connector used in hard disk driver must comply with the corresponding interface standards. An organization, called the Serial Advanced Technology Attachment (SATA) Working Group and set up by APT Technologies Inc, Dell Computer Corporation, International Business Machines, Intel Corporation, Maxtor Corporation, Quantum Corporation, and Seagate Technology released a specification to define the SATA interface and the corresponding connectors. The specification defines a first type of SATA connector connecting to a cable and a second type of SATA connector mounting to a printed circuit board (PCB).

The second type of SATA connector defined by the specification includes an insulative housing and a plurality of contacts received in the housing. The housing provides a guiding post on each one of two opposite side faces of the housing for guiding the connector to mate with a mating connector. The housing also provides a retention portion on each of the opposite side faces connected to a corresponding guiding post. Since the guiding post is connected to the corresponding retention portion, the retention portion must further outwardly extend a certain distance beyond an outermost surface of the guiding post to provide a base for retaining the corresponding board lock. However, because the guiding post is connected to the corresponding retention portion, the retention portions must further outwardly extend a certain distance beyond an outermost surface of the guiding post to provide a base for retaining the corresponding board lock. Thus, the connector has a relatively larger dimension. This design does not answer for the small dimension requirement in computer industry. In order to meet the small dimension requirement, many designs have been made. Such as U.S. Pat. No. 6,331,122 B1. However, the board lock of this Patent is too thin and when the electrical connector is soldered onto the PCB, the board lock cannot prevent the electrical connector from rotation effectively.

Hence, an improved electrical connector is required to overcome the disadvantages of the prior art.

SUMMARY OF THE INVENTION

Accordingly, an object of the present invention is to provide an improved electrical connector having a reduced longitudinal dimension.

Another object of the present invention is to provide an improved electrical connector having a board lock with an improved structure.

To achieve the above objects, an electrical connector for mating with a mating connector includes an insulative housing having a base portion, a pair of guiding portions extending upwardly from opposite ends of the base portion, a pair of mounting sections under the grounding portions, a plurality of contacts received in the housing, and a pair of board locks mounted to the mounting sections of the housing. Each board lock comprises a main base abutting against a bottom face of the mounting section, a first beam extending upwardly from a first edge of the main base and securely retained to the mounting section, a pair of second beams extending upwardly from opposite sides of the main base and securely retained into the mounting section, the second beams being opposite to each other and perpendicular to the first beam, a pair of retaining legs extending downwardly from a second edge of the main base opposite to the first edge for mounting the connector to a printed circuit board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
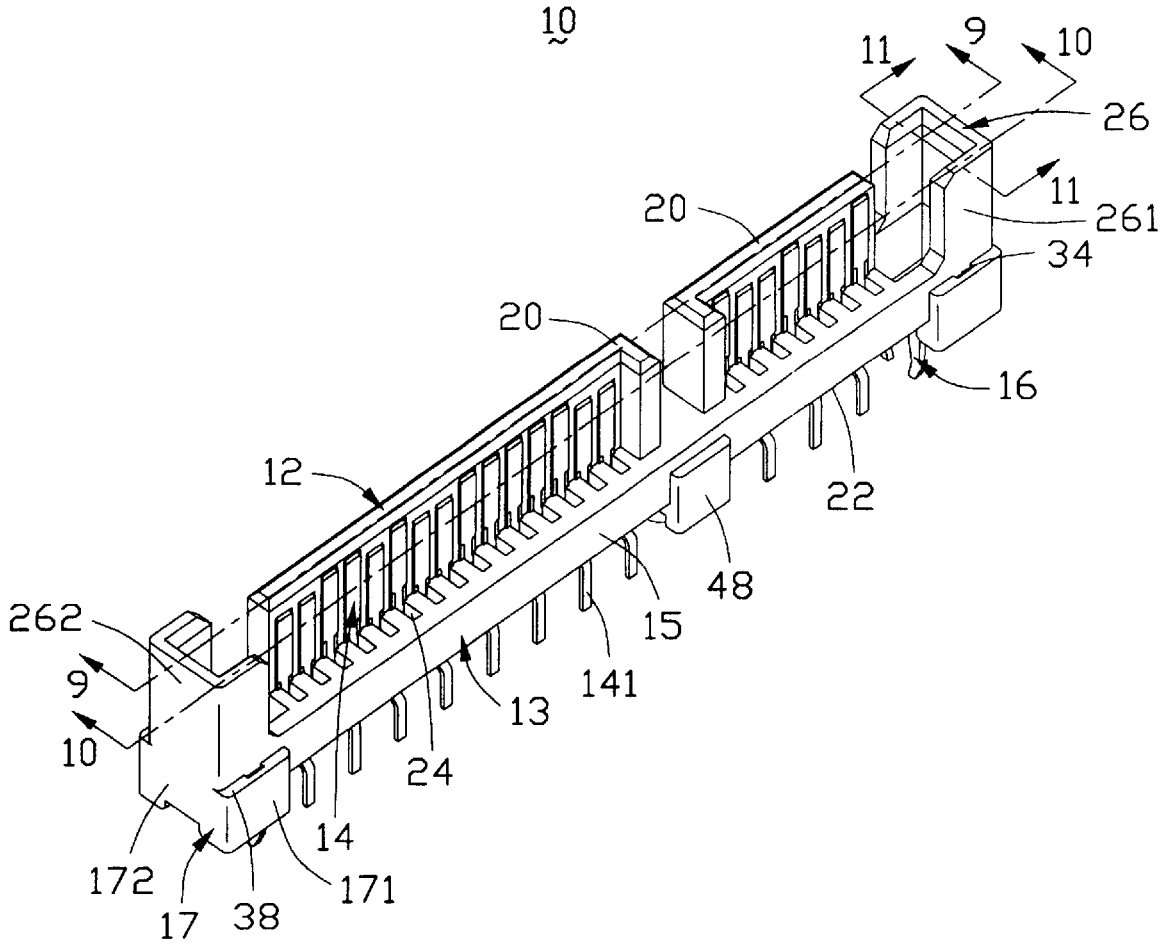
FIG. 1 is an assembled perspective view of an electrical connector in accordance with the present invention.
Figure 2:
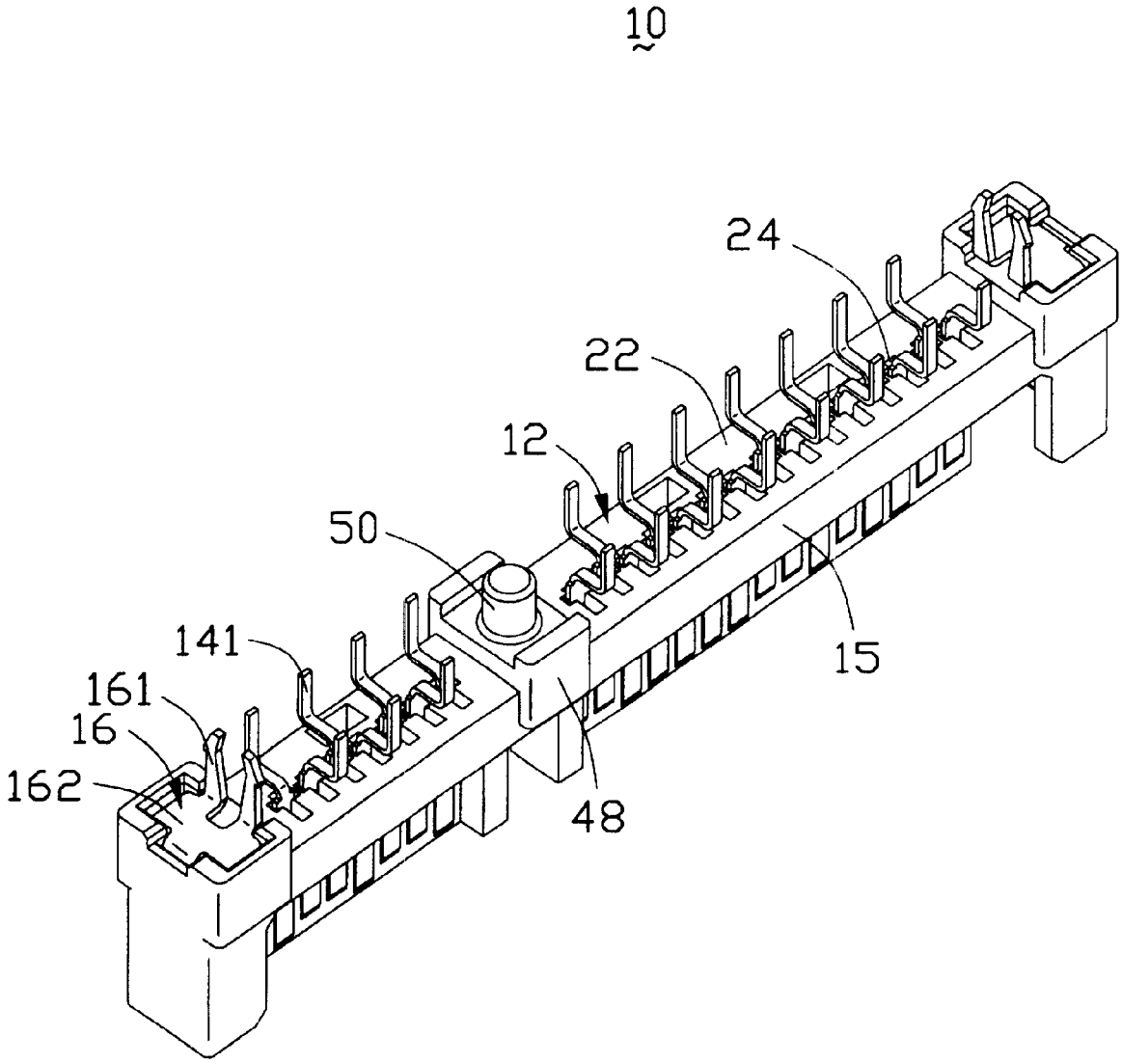
FIG. 2 is a view similar to FIG. 1 of the electrical connector, viewed from another opposite aspect.
Figure 3:
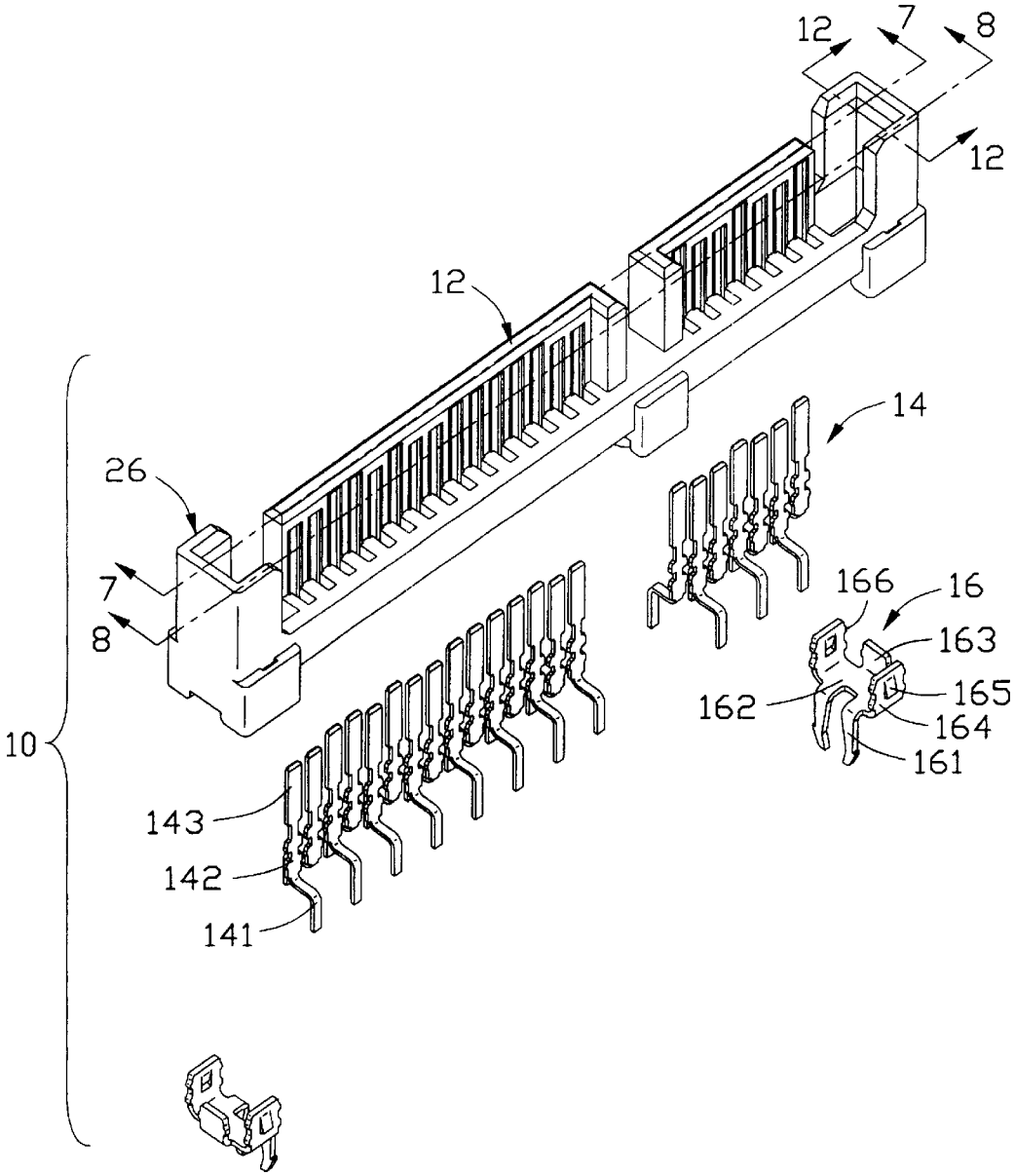
FIG. 3 is an exploded perspective view of the electrical connector of FIG. 1.
Figure 4:
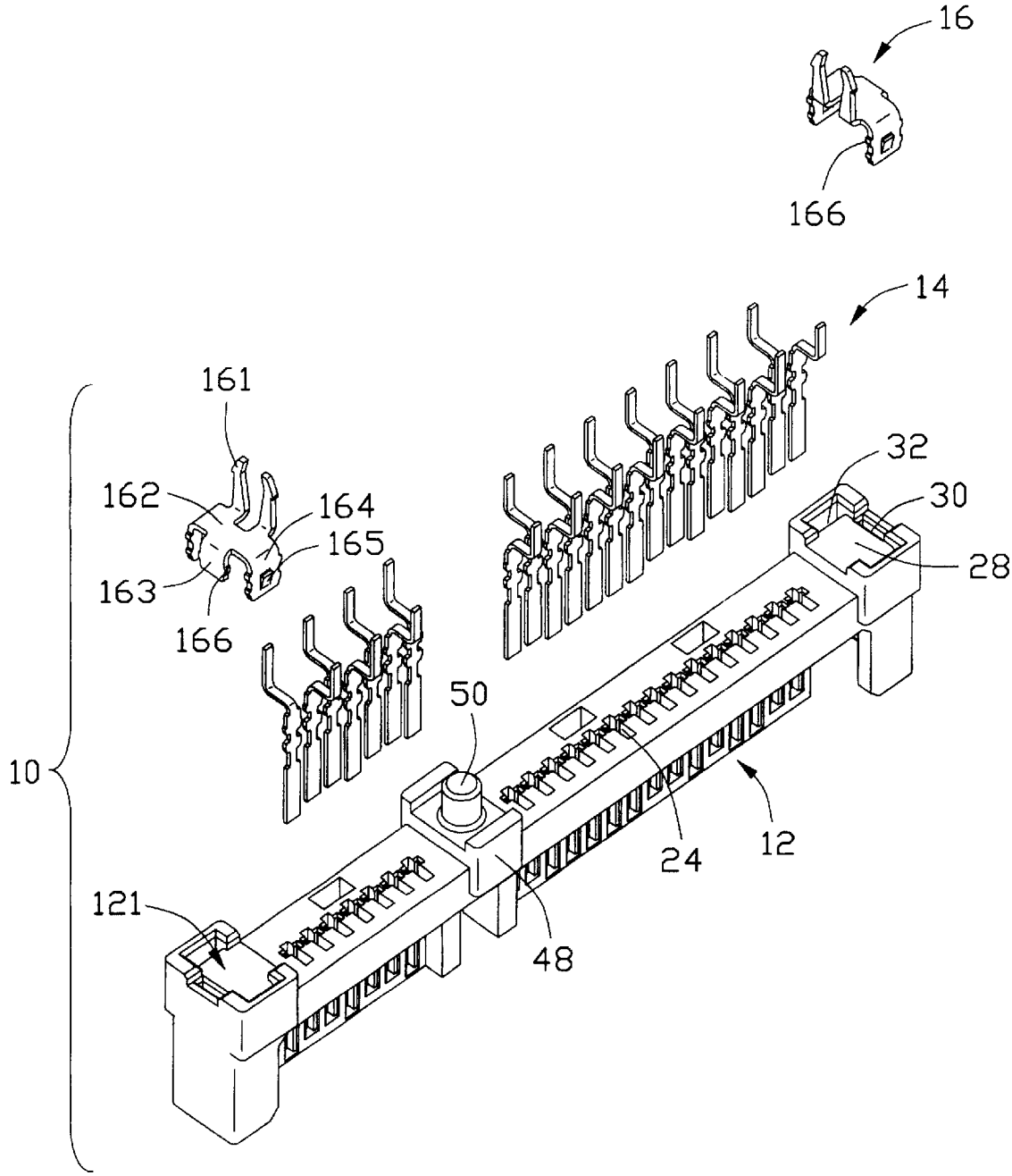
FIG. 4 is an exploded perspective view of the electrical connector of FIG. 2.

With reference to the drawings and particularly to FIGS. 1–4, an electrical connector 10 of the present invention comprises an insulative housing 12, a plurality of contacts 14, and a pair of board locks 16.

The insulative housing 12 has a base portion 13, a pair of guiding portions 26 extending upwardly from opposite ends 18 of the base portion 13 for engaging with guiding sections of the mating connector (not shown), a pair of mounting sections 17 formed on the pair of ends of the base portion 13 and locating under the corresponding guiding portions 26, and a tongue portion 20 extending upwardly from the base portion 13. A plurality of contact receiving cavities 24 is defined in the base portion 13 and the tongue portion 20 from a mounting surface 22 of the base portion 13 and through the base portion 13 to a side face of the tongue portion 20. The mounting section 17 of the housing 12 has a main portion 121 and a pair of side walls 171 protruding outwardly and beyond a pair of opposite sides 15 of the base portion 13, and an end wall 172 connecting both side walls 171 of the mounting section 17. The guiding portion 26 comprises an end section 262 integrally extending upwardly from the end wall 172 of the mounting section and a pair of side sections 261 integrally connects the end section 262. An outmost surface of the end section 262 of the guiding portion 26 is coplanar with an outmost surface of the end wall 172 of the mounting section 17 thereby minimizing the longitudinal dimension of the insulative housing 12. A first slot 30 is defined in the mounting section 17 from a bottom face 28 of the main portion 121 and between the end wall 172 and the main portion 121. A pair of second slots 32 is defined between the pair of side walls 171 of the mounting section 17 and the main portion 121 of the mounting section 17 from the bottom face 28 of the main portion 121. A pair of cutouts 34 is defined in the side walls 171 of the mounting section 17 from tops and inner faces of the side walls 171. The cutout 34 is communicating with the respective second slot 32. The housing 12 further includes a supporting means 48 formed on the mounting surface 22 and a post 50 generally protruding from the supporting means 48 for supporting the connector 10 while it is assembled to a printed circuit board (PCB).

The contact 14 comprises a retaining portion 142 at a middle of the contact 14 used for fixing the contact 14 in the contact receiving cavities 24, a contact portion 143 extending upwardly from the retaining portion 142 for electrically connecting with the mating connector and a terminal portion 141 extending downwardly from the retaining portion 142 for being soldered to the PCB.

Figure 5:
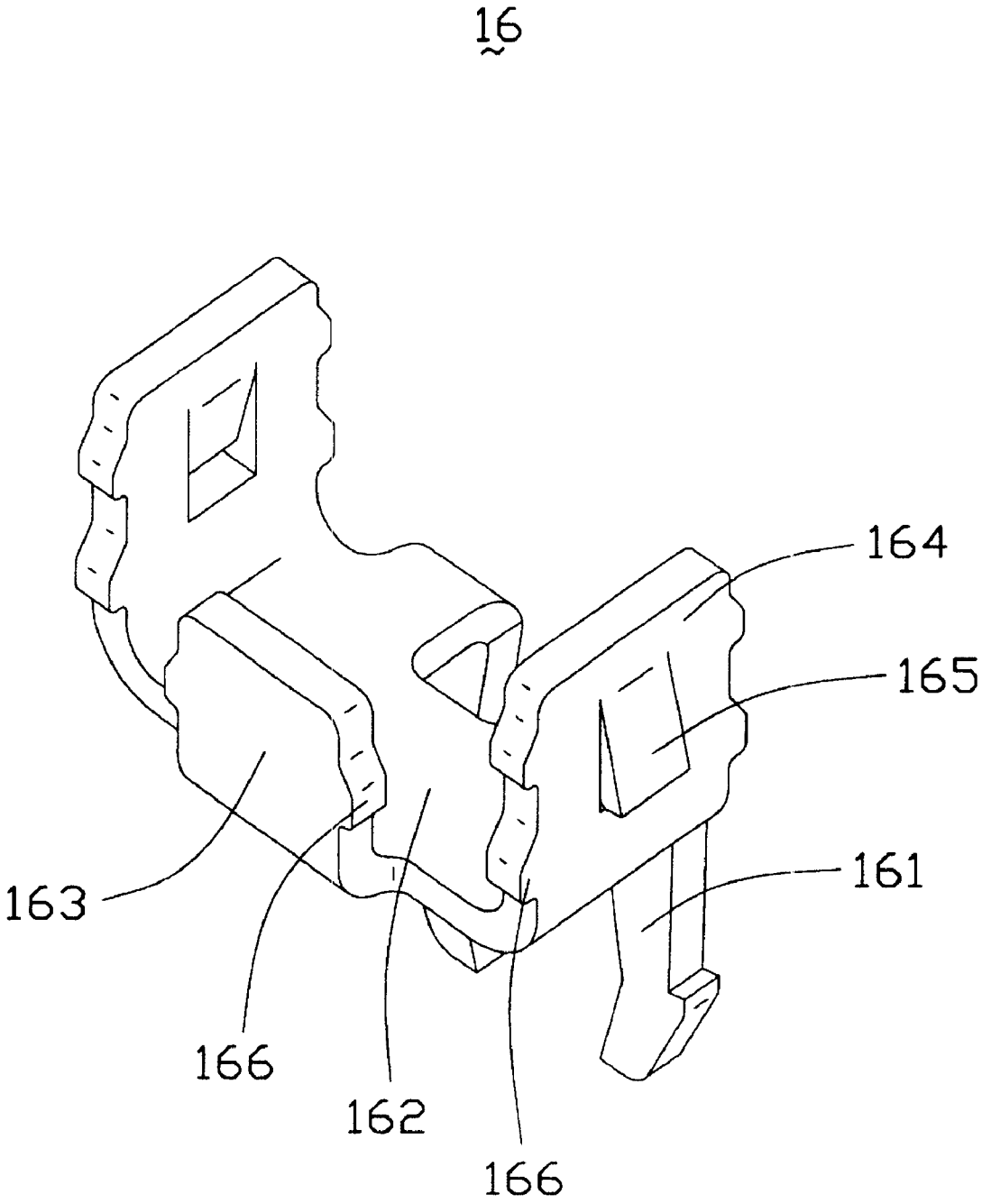
FIG. 5 is an enlarged perspective view of a board lock of the electrical connector of FIG. 3.
Figure 6:
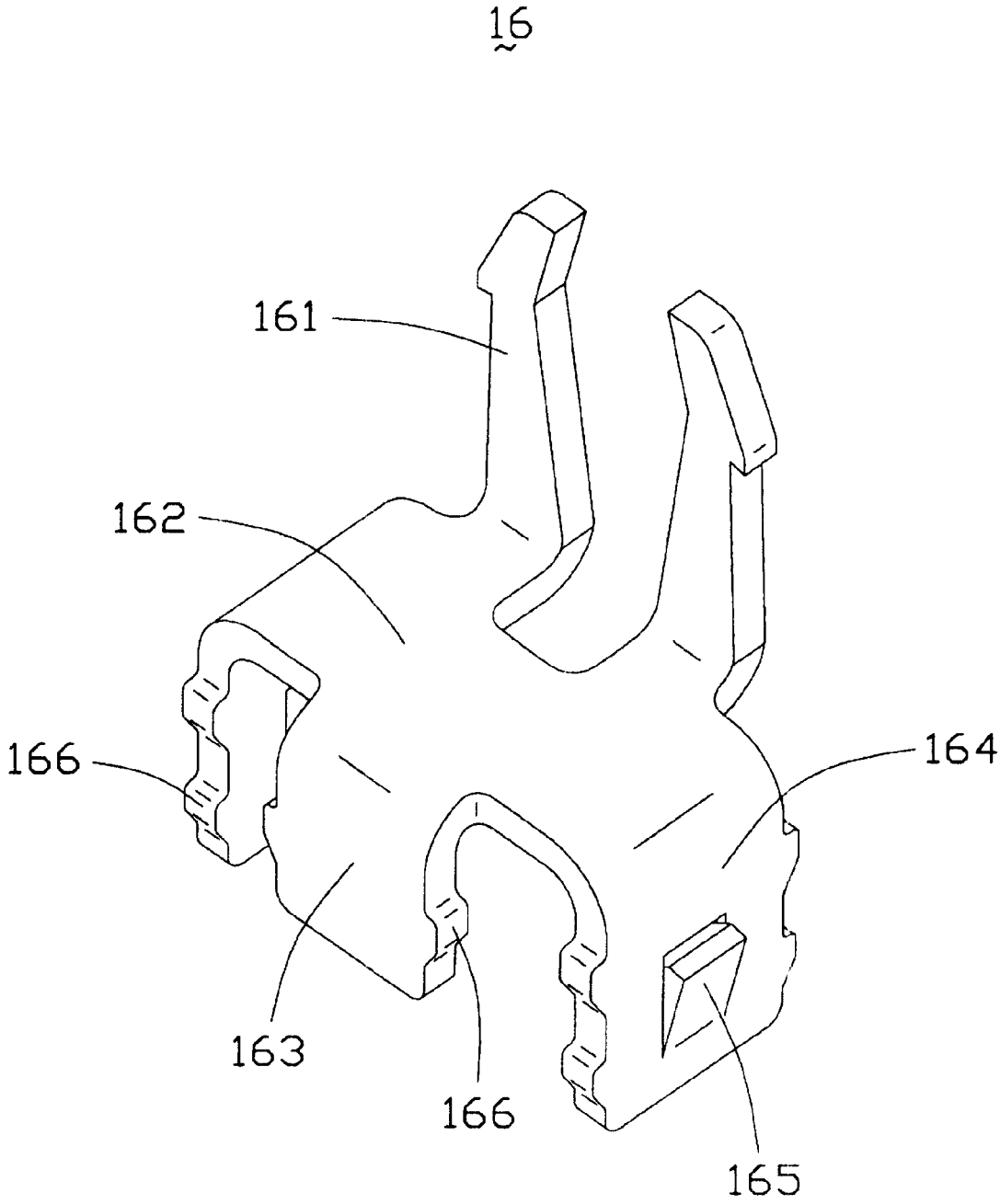
FIG. 6 is a view similar to FIG. 5 of the board lock, viewed from another opposite aspect.
Figure 7:
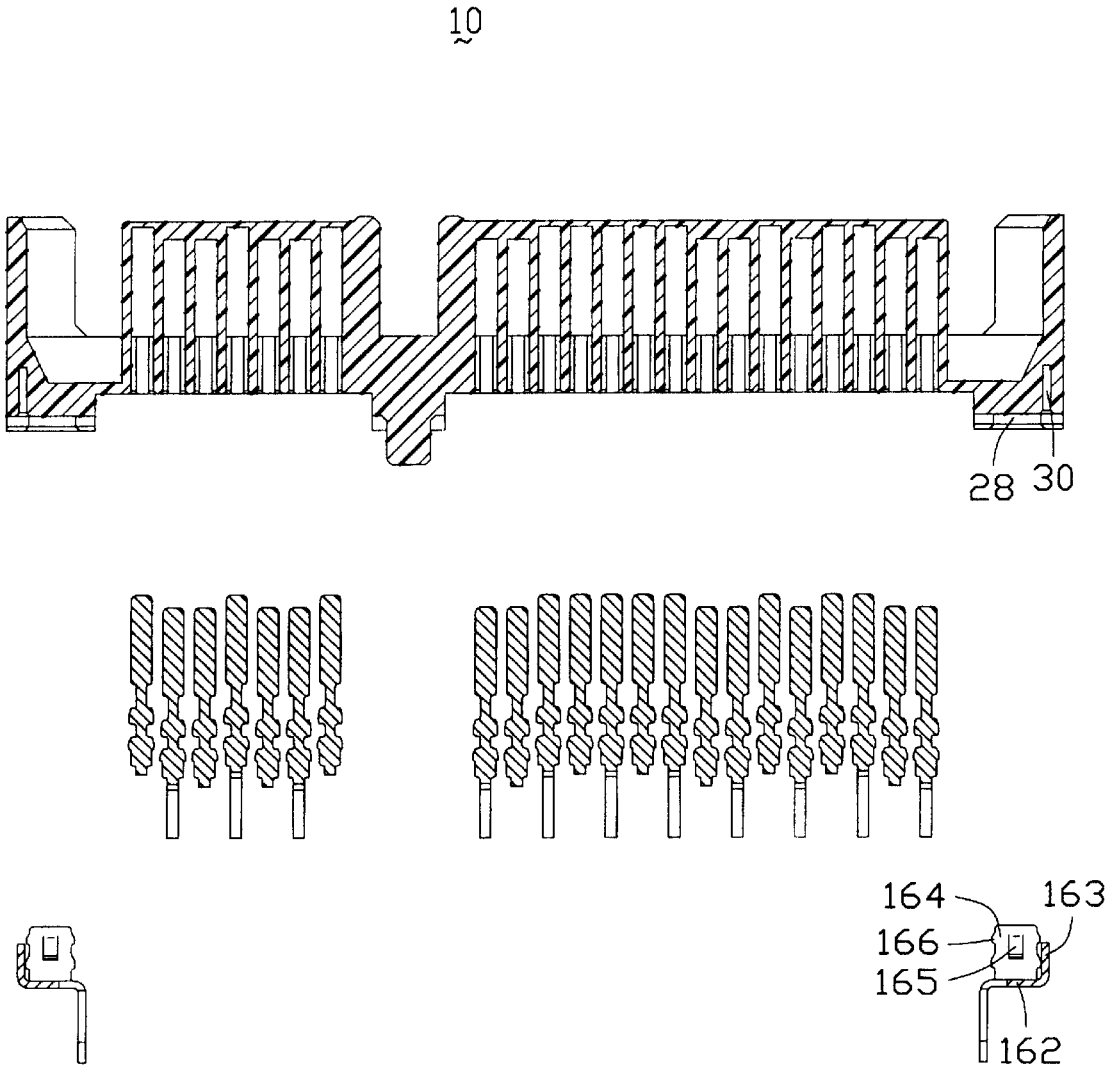
FIG. 7 is a cross-sectional view of the electrical connector taken along line 7—7 of FIG. 3.
Figure 8:
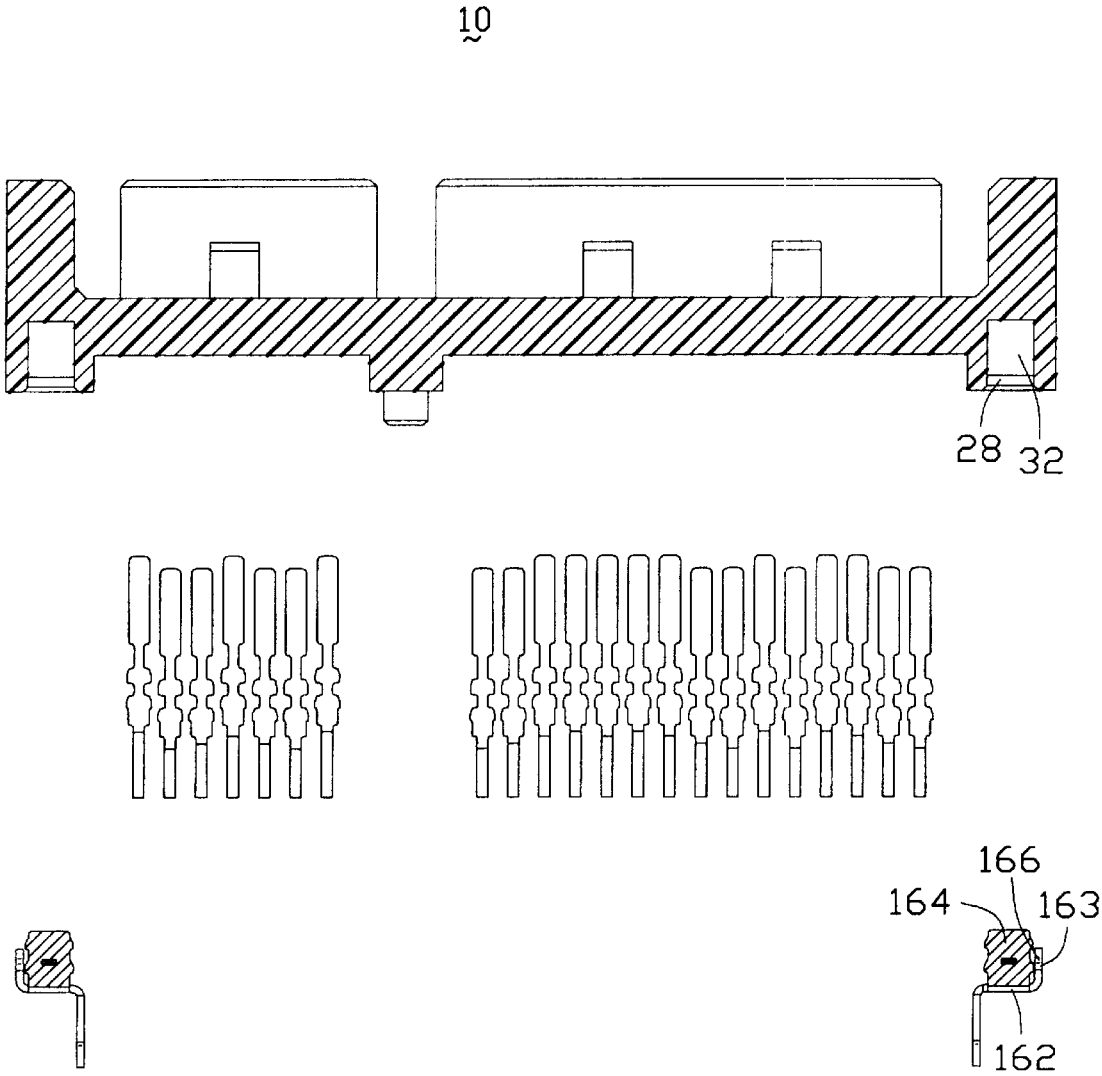
FIG. 8 is a cross-sectional view of the electrical connector taken along line 8—8 of FIG. 3.
Figure 9:
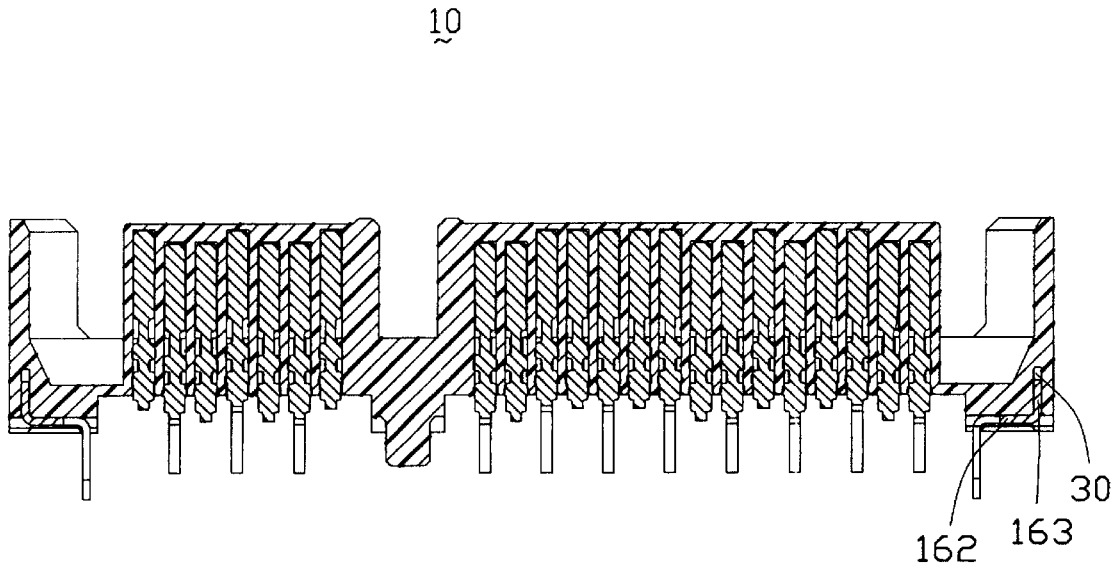
FIG. 9 is a cross-sectional view of the electrical connector taken along line 9—9 of FIG. 1.
Figure 10:
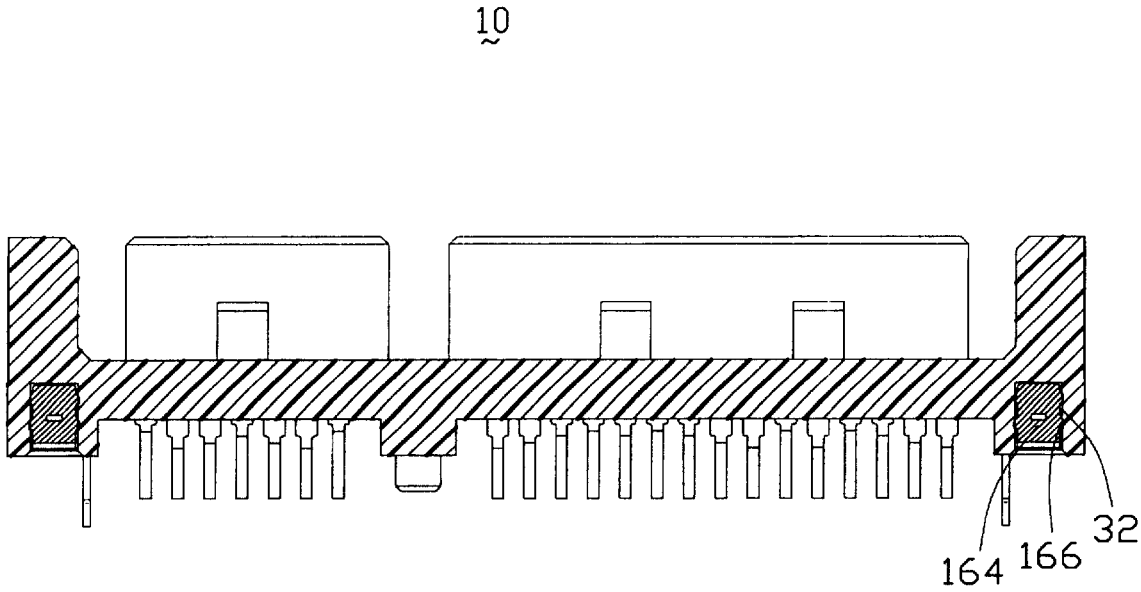
FIG. 10 is cross-sectional view of the electrical connector taken along line 10—10 of FIG. 1.
Figure 11:
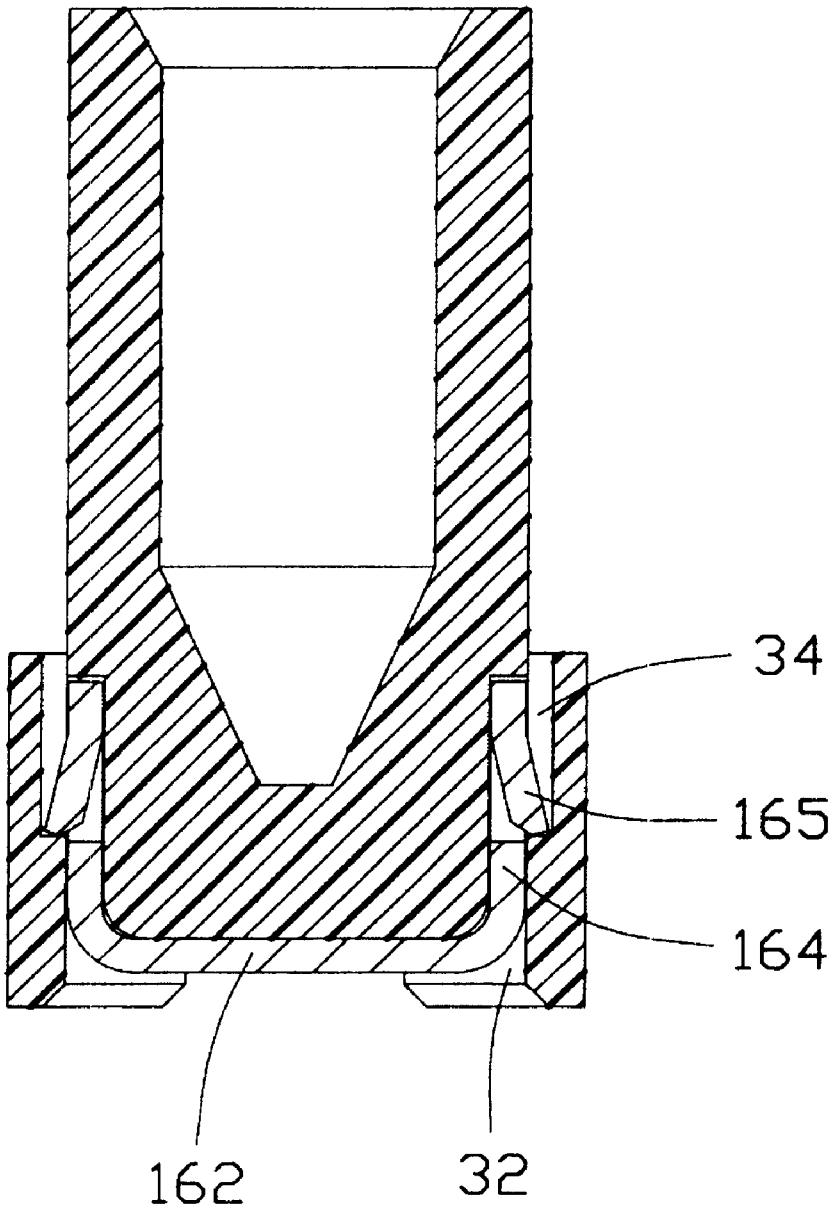
FIG. 11 is a cross-sectional view of the electrical connector taken along line 11—11 of FIG. 1.
Figure 12:
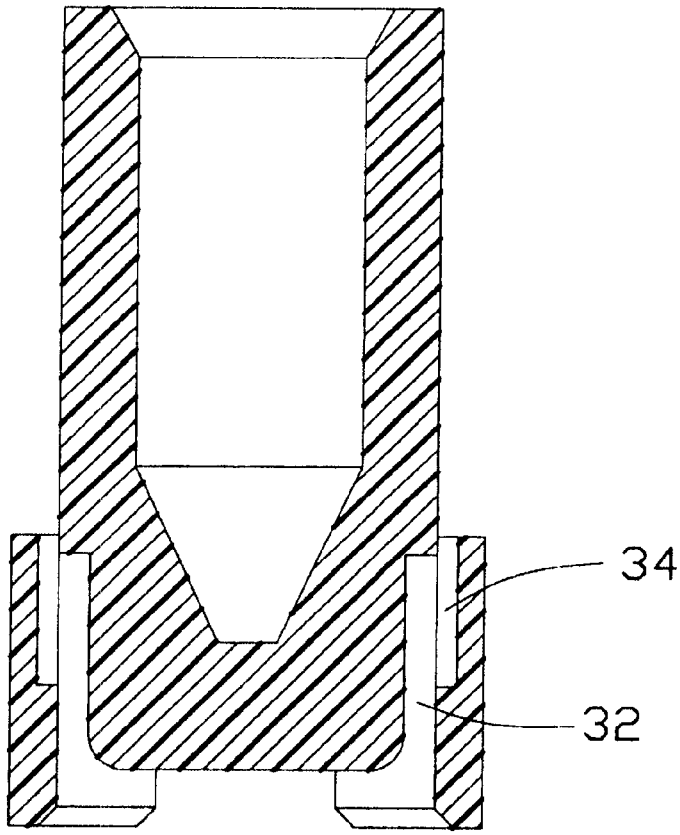
FIG. 12 is a cross-sectional view of the electrical connector taken along line 12—12 of FIG. 3.
Figure 12:
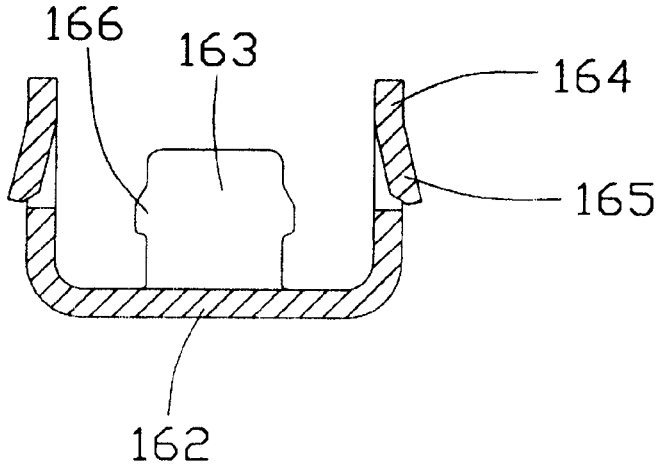

As best shown in FIGS. 3 to 12, the board lock 16 is assembled in the mounting section 17 from the bottom face 28 of the main portion 121 and comprises a main base 162 abutting against the bottom face 28, a first beam 163 extending upwardly from one end of the main base 162 and securely retained in the first slot 30, a pair of second beams 164 extending upwardly from opposite sides of the main base 162 and securely retained in the second slots 32, a pair of retaining legs 161 extending downwardly from the other end of the main base 162 for mounting the connector 10 to the PCB. The second beams 164 are perpendicular to the first beam 163. A pair of protrusions 165 protrudes outwardly from the second beam 164 and received into the cutouts 34 of the side walls 171 of mounting section 17 so that the board lock 16 is securely fixed in the housing. A plurality of barbs 166 is formed on the sides of the first and second beams 163, 164 and interfering with inner faces of the first and second slots 30 and 32.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. An electrical connector for mating with a mating connector, comprising:

an insulative housing having a base portion, a pair of guiding portions extending upwardly from opposite ends of the base portion for engaging with guiding sections of the mating connector, a pair of mounting sections formed on the opposite ends of the base portion and locating under the guiding portions;

a plurality of contacts received in the housing; and a pair of metal board locks mounted to the mounting sections of the housing and each board lock comprising a main base abutting against a bottom face of the mounting section, a first beam extending upwardly from a first edge of the main base and securely retained to the mounting section, a pair of second beams extending upwardly from opposite sides of the main base and securely retained into the mounting section, the second beams being opposite to each other and perpendicular to the first beam, a pair of retaining legs extending downwardly from a second edge of the main base opposite to the first edge for mounting the connector to a printed circuit board; wherein the mounting section of the housing has a main portion connecting the end of base portion and a pair of side walls protruding outwardly and beyond a pair of opposite sides of the base portion, and an end wall connecting both side walls of the mounting section; wherein the guiding portion comprises an end section integrally extending upwardly from the end wall of the mounting section, an outmost surface of the end wall of the mounting section is coplanar with an outmost surface of the guiding portion; wherein both side walls and the end wall together circulate the main portion; wherein a first slot is defined in the mounting section from a bottom face of the mounting section and between the main portion and the end wall of the mounting section, the first beam is securely fixed into the first slot.

2. The electrical connector as claimed in claim 1, wherein a pair of second slots is defined between the pair of side walls of the mounting section and the main portion of the mounting section from the bottom face of the mounting section, the second beams of the metal board lock are respectively securely received in the second slots.

3. The electrical connector as claimed in claim 2, wherein a pair of cutouts defined in the side walls of the mounting sections from tops and inner faces of the side walls and communicates with the second slots, a pair of protrusions protrudes outwardly from the second beams and is received in the cutouts so that the board lock is securely fixed in the housing.

4. The electrical connector as claimed in claim 3, wherein a plurality of barbs is formed on the sides of the first and second beams for intervening inner faces of the first and second slots.

5. The electrical connector as claimed in claim 1, wherein at least a tongue portion extends upwardly from the base portion of the housing, a plurality of passageways is defined in the tongue portion, the contacts are received into the passageways.

6. An electrical connector comprising:

an elongated insulative housing has a base portion defining two opposite sides with a plurality of contacts positioned therebetween;

a pair of mounting sections located at two opposite elongated ends of the housing, each of said mounting sections including a main portion and two side walls protruding outwardly beyond the corresponding sides of the housing, respectively;

a first slot extending upwardly from a bottom face of each of mounting sections at one end of the housing;

a pair of second slots extending upwardly from the bottom face of the mounting sections and along the corresponding sides, respectively, said pair of second slots being essentially perpendicular to said first slot;

a pair of cutouts extending downwardly from top faces of the corresponding side walls, respectively, and in communication with the corresponding second slots laterally;

a pair of board locks upwardly secured to the corresponding mounting sections, respectively, each of said board locks including a main base with a first beam upwardly extending from one edge thereof and received in the first slot, a pair of second beams upwardly extending from two opposite edges thereof and perpendicular to said one edge and received in the correspond second slots, respectively, at least one retaining legs downwardly extending from another edge opposite to said one edge for mounting to a printed circuit board, and a pair of protrusions protruding from the corresponding second beams and received in the corresponding cutouts, respectively.

* * * * *